US007048145B2

(12) United States Patent
Mitchell

(10) Patent No.: US 7,048,145 B2
(45) Date of Patent: May 23, 2006

(54) LIQUID DELIVERY APPARATUS

(76) Inventor: David Mitchell, Church Farm, Winfarthing, Diss, Norfolk OP22 2ED (GB)

( * ) Notice: Subject to any disclaimer, the term of this patent is extended or adjusted under 35 U.S.C. 154(b) by 18 days.

(21) Appl. No.: 10/312,422

(22) PCT Filed: Jun. 26, 2001

(86) PCT No.: PCT/GB01/02830

§ 371 (c)(1),
(2), (4) Date: Jul. 7, 2003

(87) PCT Pub. No.: WO02/02243

PCT Pub. Date: Jan. 10, 2002

(65) Prior Publication Data

US 2004/0025965 A1 Feb. 12, 2004

(30) Foreign Application Priority Data

Jun. 29, 2001 (GB) ..... 0015992.1

(51) Int. Cl.
*B05B 12/08* (2006.01)

(52) U.S. Cl. ..... 222/61; 222/386.5; 222/394; 222/608; 239/67; 239/322; 239/323; 239/328

(58) Field of Classification Search ..... 222/61, 222/386.5, 389, 394, 608; 239/67, 322, 323, 239/328, 533.15, 569, 570
See application file for complete search history.

(56) References Cited

U.S. PATENT DOCUMENTS 4,809,910 A * 3/1989 Meyer ..... 239/1
4,863,101 A * 9/1989 Pater et al. ..... 239/99
5,249,745 A * 10/1993 Bertolotti ..... 239/76
5,316,215 A 5/1994 Mitchell ..... 239/67

* cited by examiner

*Primary Examiner*—J. Casimer Jacyna
(74) *Attorney, Agent, or Firm*—John S. Reid; Reidlaw, L.L.C.

(57) ABSTRACT

A liquid delivery apparatus includes a vessel having an inlet and an outlet, and a valve between the vessel and the outlet. The valve has an opening, a closure member for closing the opening, and a biasing means to hold the valve in a normally-closed position. A valve control mechanism controls operation of the valve in response to pressure of liquid and air in the vessel. A transmitting means transmits the pressure to the valve control mechanism. The valve control mechanism includes a moveable element that can be acted on by the pressure in the vessel and transmit a resultant force to the closure member to thereby open the valve. The respective effective surface areas of the moveable element and the closure member and the force of the biasing means are chosen such that the closure member is openable when the pressure in the vessel reaches a predetermined level.

66 Claims, 14 Drawing Sheets

LIQUID DELIVERY APPARATUS

CROSS REFERENCE TO RELATED APPLICATIONS

This application is a U.S. National Stage filing of Patent Cooperation Treaty ("PCT") Patent Application No. PCT/GB01/02830, filed Jun. 26, 2001, which in turn claims priority to Great Britain patent application serial number GB0015992.1, filed in The United Kingdom on Jun. 29, 2000.

FIELD OF THE INVENTION

The present invention relates to a liquid delivery apparatus, such as a liquid delivery apparatus that is to be used for distributing liquid waste over agricultural land.

BACKGROUND

In European Patent No. 0548159 (and the corresponding U.S. Pat. No. 5,316,215), there is claimed a liquid delivery apparatus comprising (i) a liquid reservoir into which a liquid may be introduced via an inlet to pressurise said liquid in the reservoir;

(ii) an outlet via which said liquid may be discharged from the reservoir under the pressure of the liquid in the reservoir;

(iii) a valve between the reservoir and the outlet to control passage of liquid from the reservoir to the outlet, said valve having (a) an opening, (b) a closure member adapted to close the opening, and (c) a biasing means, the arrangement of the components of the valve being such that the valve is normally held closed under the force of the biasing means and the pressure of the liquid in the reservoir;

(iv) a valve control mechanism for controlling the operation of the valve in response to the pressure of the liquid in the reservoir; and (v) a means for transmitting the pressure in the reservoir to the valve control mechanism;

wherein the valve control mechanism comprises a moveable element which is capable of being acted on by the pressure of the liquid in the reservoir and transmitting a resultant force to the closure member of the valve in a direction to open the valve, and wherein the respective effective surface areas of the moveable element and the closure member and the force of the biasing means are chosen such that the closure member is openable when the pressure of the liquid in the reservoir reaches a predetermined level.

The liquid delivery apparatus disclosed in the aforesaid patents includes a housing and an inner moveable wall which sub-divides the housing into first and second chambers which are of variable volume depending upon the position of the inner moveable wall in the housing, the first chamber containing air as a compressible fluid and the second chamber defining the liquid reservoir, and the inner moveable wall being a flexible membrane such as a flexible bag.

SUMMARY

It has now been found according to one aspect of the present invention that the presence of an inner moveable wall (such as a flexible membrane) in the housing is not necessary.

According to one aspect of the present invention, there is provided a liquid delivery apparatus comprising (i) a vessel into which a liquid may be introduced via an inlet to partially fill the vessel and to pressurise the liquid that partially fills the vessel and the air that fills the remainder of the vessel;

(ii) an outlet via which said liquid may be discharged from the vessel under the pressure of the liquid and air in the vessel;

(iii) a valve between the vessel and the outlet to control passage of liquid from the vessel to the outlet, said valve having (a) an opening, (b) a closure member adapted to close the opening, and (c) a biasing means, the arrangement of the components of the valve being such that the valve is normally held closed under the force of the biasing means and the pressure of the liquid and air in the vessel;

(iv) a valve control mechanism for controlling the operation of the valve in response to the pressure of the liquid and air in the vessel; and (v) a means for transmitting the pressure of the air in the vessel to the valve control mechanism;

wherein the valve control mechanism comprises a moveable element which is capable of being acted on by the pressure of the air in the vessel and transmitting a resultant force to the closure member of the valve in a direction to open the valve, and wherein the respective effective surface areas of the moveable element and the closure member and the force of the biasing means are chosen such that the closure member is openable when the pressure of the liquid in the vessel reaches a predetermined level.

Thus, the apparatus according to the first aspect of the invention does not have, or need to have, an inner moveable wall in the housing.

However, it has been found, according to another aspect of the present invention, that the apparatus can be provided with a second vessel that includes an inner moveable wall (such as flexible member).

According to another aspect of the present invention, there is provided a liquid delivery apparatus comprising (i) a first vessel into which a liquid may be introduced via an inlet to partially fill the first vessel and to pressurise the liquid that partially fills the first vessel and the air that fills the remainder of the first vessel;

(ii) an outlet via which said liquid may be discharged from the first vessel under the pressure of the liquid and air in the first vessel;

(iii) a valve between the first vessel and the outlet to control passage of liquid from the first vessel to the outlet, said valve having (a) an opening, (b) a closure member adapted to close the opening and (c) a biasing means, the arrangement of the components of the valve being such that the valve is normally held closed by the biasing means;

(iv) a valve control mechanism for controlling the operation of the valve in response to the pressure of the liquid and air in the first vessel;

(v) a means for transmitting the pressure of the liquid and air in the first vessel to a first chamber of a second vessel that includes an inner moveable wall which sub-divides the second vessel into said first chamber and a second chamber which are of variable volume depending upon the position of the said inner moveable wall in the vessel; and (vi) a means for transmitting the pressure of the air in the second chamber of the second vessel to the valve control mechanism;

wherein the valve control mechanism comprises a moveable element which is capable of being acted on by the pressure of the air in the second chamber and transmitting a resultant force to the closure member of the valve in a direction to open the valve, and wherein the respective effective surface areas of the moveable element and the closure member and the force of the biasing means are chosen such that the closure member is opened when the pressure of the liquid and air in the first vessel reaches a predetermined level.

The vessel into which the liquid is introduced, or the first and/or second vessels, as the case may be, is normally a rigid vessel, but could be a non-rigid vessel (e.g. a flexible or resilient vessel) if it is such that the liquid introduced therein, and the air present therein, can be pressurised therein.

Preferably, the inlet includes an upright tube extending upwardly into the vessel or the first vessel. In this case, the height of the tube in the vessel determines the level of liquid remaining in the vessel after discharge.

Alternatively, a baffle plate is preferably disposed in the vessel or the first vessel, between the valve opening and the inlet, so as partially to subdivide the interior of the vessel or the first vessel into first and second compartments such that flow of liquid from one compartment to the other is possible.

The inlet to the vessel or the first vessel may include a non-return valve.

The moveable element of the valve control mechanism may comprise either a diaphragm in a pressure chamber or a bellows. In the latter case, the apparatus preferably includes means for varying the length of the bellows.

Preferably, the biassing means comprises a compression spring, and the apparatus includes means for varying the degree of compression of the compression spring.

Preferably, the means for transmitting the pressure to the valve control mechanism comprises either (a) a pressure line directly connecting the vessel to the pressure chamber containing the diaphragm or to the bellows, or (b) a first pressure line directly connecting the first vessel to the first chamber of the second vessel and a second pressure line directly connecting the second chamber of the second vessel to the pressure chamber containing the diaphragm or to the bellows. Preferably, a regulating tank is disposed in the pressure line, or in either of both of the first and second pressure lines.

The closure member of the valve is preferably one that is able to open in two or more stages in which the closure member has different effective surface areas such that the force required to open the valve is less in the second (or subsequent) stage than it is in the first (or previous) stage.

In another preferred embodiment, the diaphragm or the bellows is acted on directly by the pressure of the liquid introduced via the inlet.

The outlet via which the liquid may be discharged preferably comprises an upright rotatable discharge tube having one or more offset discharge nozzles connected thereto. A moveable flap may be mounted at the end of the discharge nozzle, or a moveable ball mounted in the discharge nozzle.

Preferably, the rotatable discharge tube has a rope or strap wound around it via which reciprocating movement of the rope or strap can cause or allow rotation of the discharge tube in a stepwise manner.

The rotatable discharge tube is preferably rotated by a drive mechanism that in turn is driven by a bellows that in turn is driven by pressure change.

The apparatus may further comprise a pump for pumping air into the vessel or the first vessel.

The invention will now be described, by way of example, with reference to the drawings in which:

DETAILED DESCRIPTION

Figure 1:
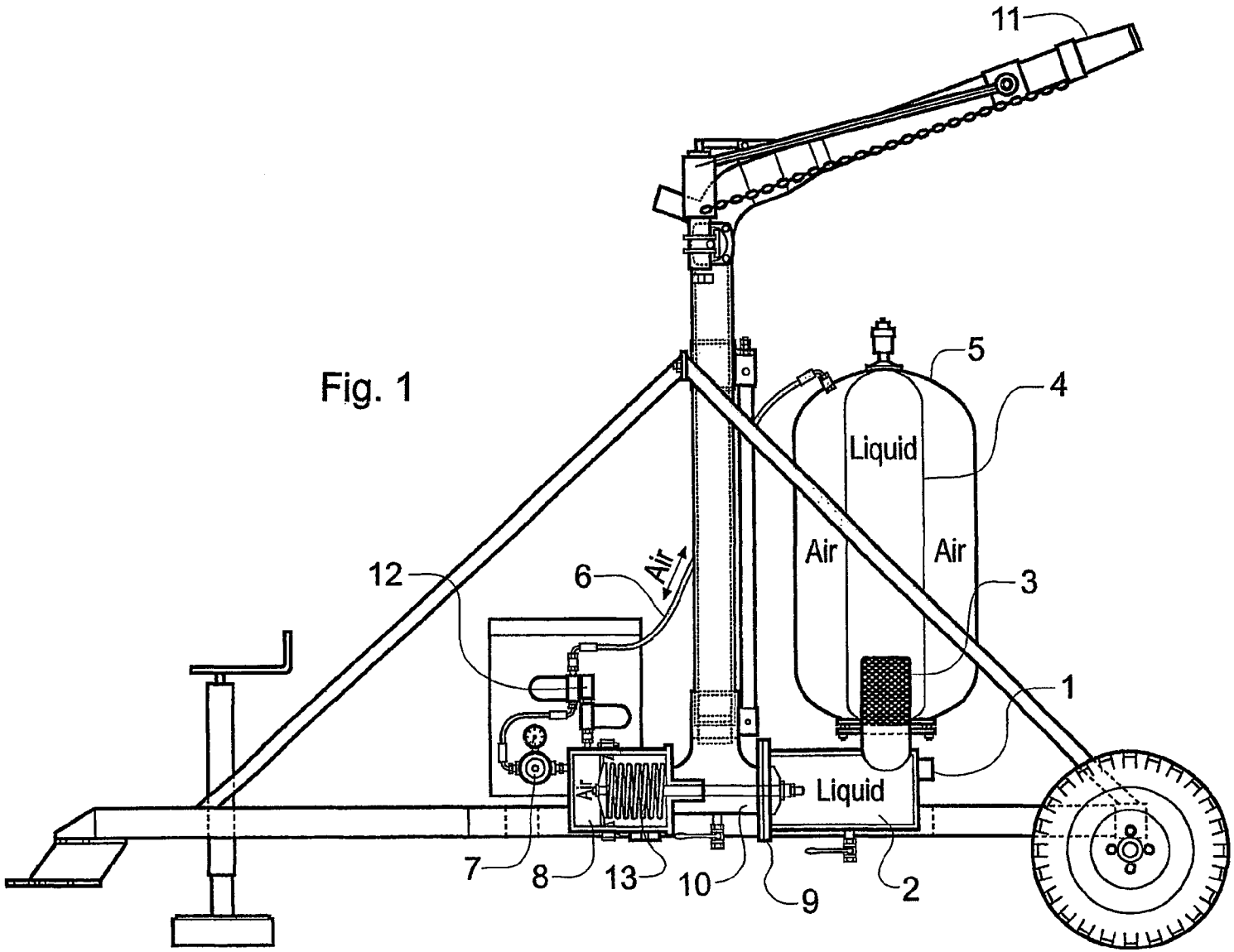
FIG. 1 is a view of a liquid delivery apparatus as already in use, in accordance with European Patent No. 0548159.

Referring to FIG. 1, there is shown an existing liquid delivery apparatus, as more fully disclosed in European Patent No. 0548159 (and U.S. Pat. No. 5,316,215). Liquid under pressure is fed via an inlet 1 to a chamber 2 and from there via a filter 3 to the interior of a rubber bag 4 disposed within a cylindrical pressure vessel 5. The pressure within the bag 4 compresses the air in the annular space, around the bag, within the vessel 5. The annular space is connected via an air line 6 and a diaphragm relief valve 7 to a chamber 8 containing an actuating member, i.e. a diaphragm, of a poppet valve 9. Thus, the introduction of liquid under pressure into the bag 4 causes an increase in pressure in the chamber 8 until, at a given pressure, as more fully disclosed in the above patents, the poppet valve 9 opens for a brief period of time to allow liquid under pressure to enter a chamber 10 and from there to be discharged from a nozzle 11.

The release of the pressure in the vessel 5 and in the chamber 8, as a result of the opening of the poppet valve 9, allows the poppet valve to close again, by the action of a compression spring 13, and this cycle is then repeated upon the introduction of more liquid under pressure through the inlet 1.

When the poppet valve 9 closes, the air in the chamber 8 returns via a non-return valve 12 to the air line 6.

Figure 2:
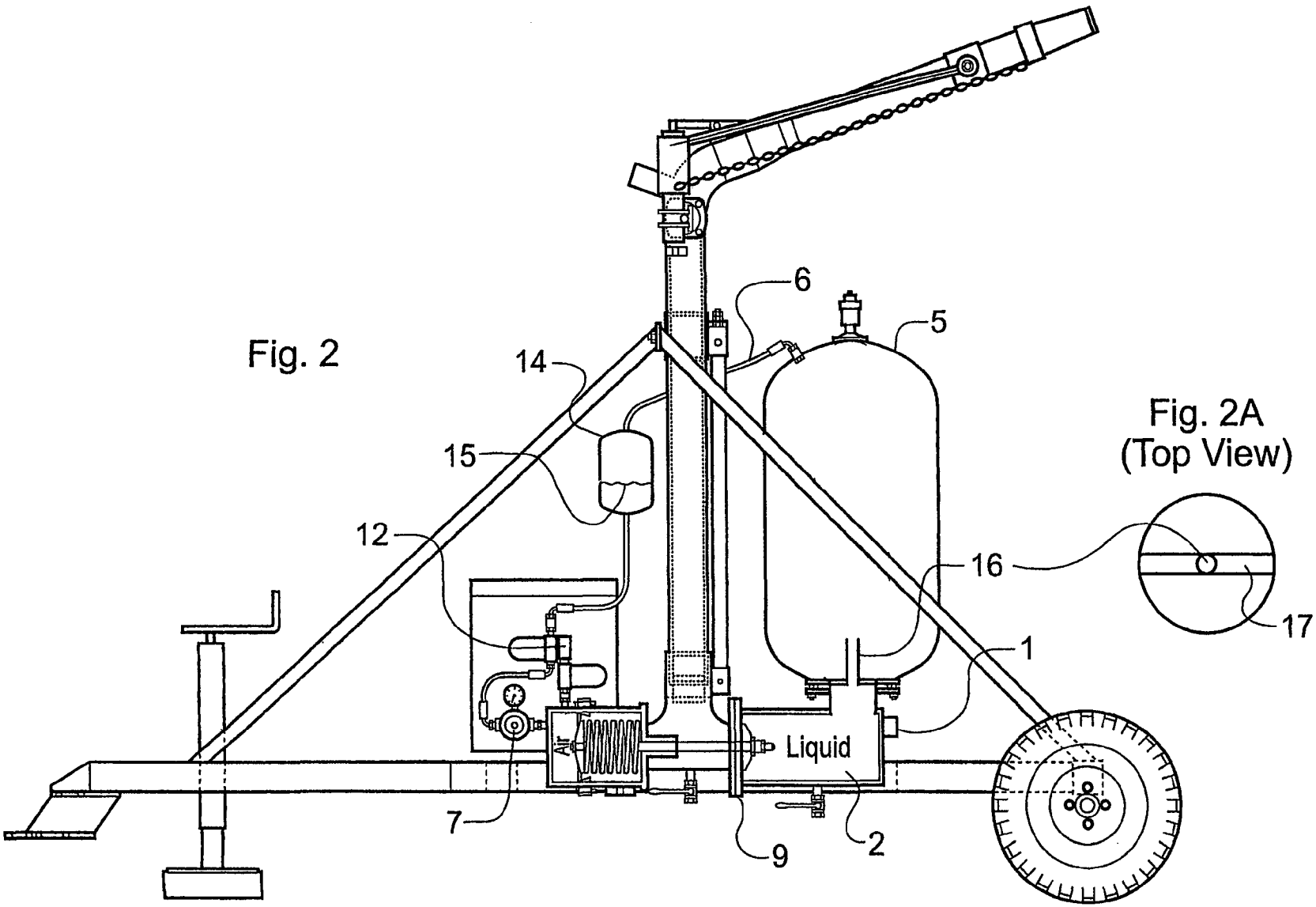
FIGS. 2 (and 2A) and 3 show various improvements, in accordance with the present invention, in the apparatus shown in FIG. 1.
Figure 3:
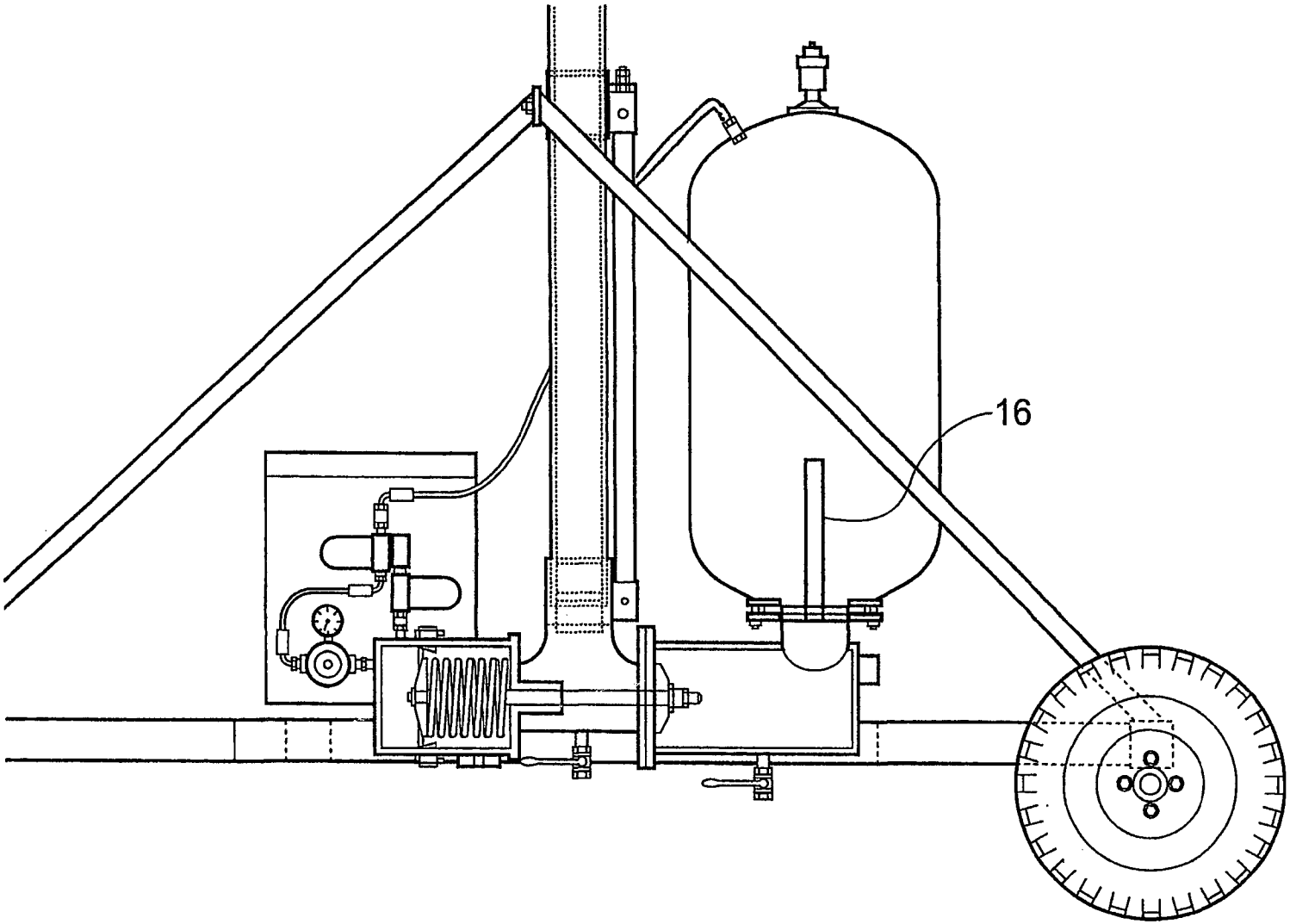

FIGS. 2 and 3 show a modification of the apparatus of FIG. 1. In this modification, in accordance with the present invention, the pressure vessel 5 does not contain the rubber bag 4. Instead, a small slave accumulator 14, containing a diaphragm or bag 15, is disposed in the air line 6.

In the case of the use of a diaphragm 15 (rather than the use of a bag 15), the diaphragm does not tend to scuff along the wall of the accumulator 14 (unlike the bag 4 in the vessel 5 of FIG. 1).

Also, in place of the inlet filter 3, there is provided a tube 16 (FIGS. 2 and 2A) mounted on a mounting plate or bar 17 extending across the inlet to the pressure vessel 5, between the chamber 2 and the vessel 5, leaving two semicircular gaps between the bar 17 and the wall of the inlet.

The tube 16 and the mounting plate or bar 17 are so dimensioned that a vortex is created to allow excess air to be bled from the vessel 5 into the chamber 2. Thus, the rate of flow of liquid around the tube 16 has to be less than the rate of flow of liquid in the tube, so that a vortex is created around the top of the tube 16 so that, as the level of liquid falls in the vessel 5, excess air is bled into the chamber 5 (i.e. the amount of air left in the vessel 5 upon discharge of the liquid).

The height of the tube 16 controls the level of liquid in the vessel 5.

Figure 4:
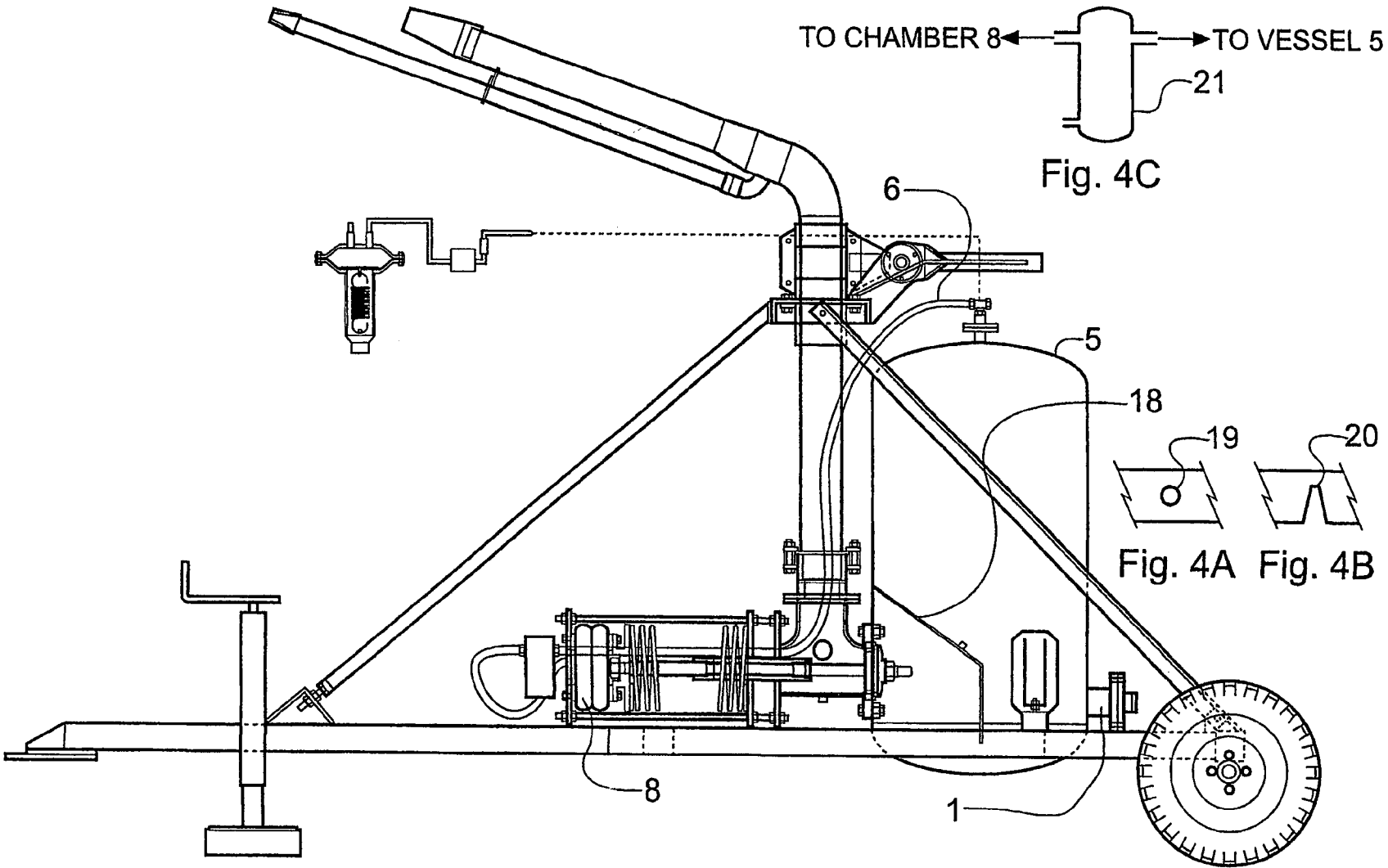
FIGS. 4 (and 4A, 4B and 4C) and 5 show other liquid delivery apparatus in accordance with the present invention.

In accordance with another modification, as shown in FIG. 4, a fixed baffle plate 18, containing a hole 19 or V-shaped slot 20 (FIGS. 4A and 4B), can be used to control the water level in the pressure vessel 5. The plate 18 (also shown in FIG. 5) has a sloping semicircular portion extending from the walls of the vessel 5, and an upright rectangular portion extending downwardly from the sloping portion to leave a gap below it through which liquid can flow.

Furthermore, the inlet 1 can be in the form of a non-return valve.

Also, in accordance with another modification, also shown in FIG. 4 (and also FIG. 5), the air line 6 can be connected directly to the chamber 8 containing the poppet valve actuating diaphragm (or a bellows, that can be used in place of the diaphragm). Alternatively, the air line 6 can be connected to the chamber 8 via a small tank 21 (FIG. 4C). A restriction can be placed in the line leading to the chamber 8, or in the line leading to the vessel 5, to control the time for which the poppet valve 9 is open. Also, the restriction in the line leading to the chamber 8, and the size of the tank 21, can be varied to vary the speed of the opening and closing of the poppet valve 9 and the time for which it is open.

Figure 5:
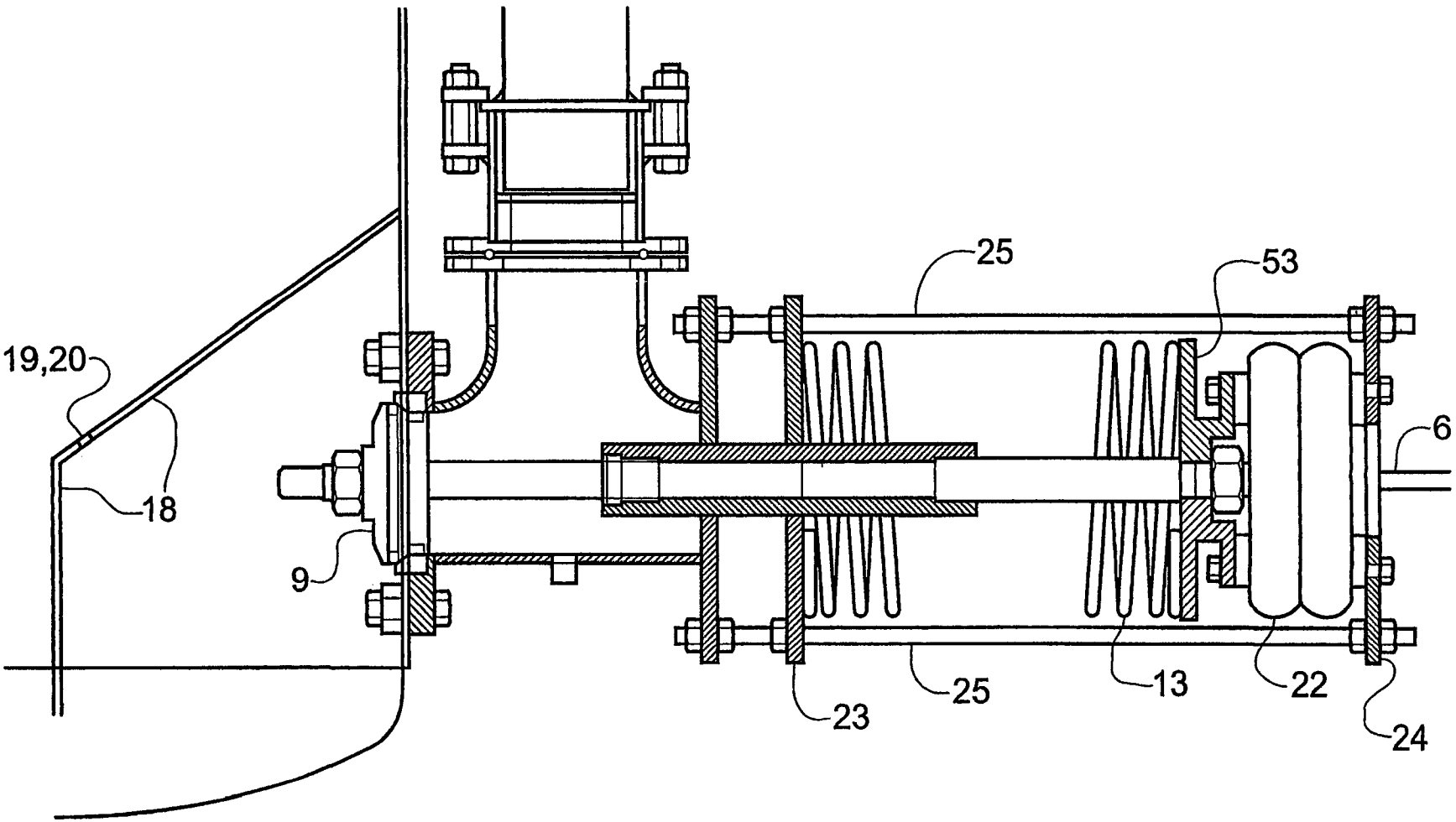

FIG. 5 shows on an enlarged scale the poppet valve 9 and the mechanism, in the form of a bellows 22, for actuating the poppet valve 9. As shown in FIG. 5, the bellows 22 and the compression spring 13 are held between plates 23 and 24 (the spring 13 itself being held on plate 53) which in turn are mounted on threaded bars 25 (three or four, usually) and held by nuts. By changing the distance between plates 23 and 24, it is possible to change the opening and closing pressures of valve 9, i.e. the higher the pressure on the spring 13 the higher are the opening and closing pressures of valve 9.

The apparatus shown in FIG. 1 has proven to be satisfactory in use, but needs to have its performance improved, and needs to be made easier to service and cheaper to build. Also, the rubber bag 5 used as the bladder has a tendency to fail.

The apparatus shown in FIG. 2 is an improvement since the removal of the bag 4 from the vessel 5 increases reliability and the absence of the filter 3 increases flow and allows coarser materials to be handled. It is still necessary to use the diaphragm relief valve 7, the non-return valve 12 and filters as on the apparatus of FIG. 1.

The valve opening pressure is controlled by the diaphragm relief valve 7. If, for instance, the main valve 9 opens at 5 bar without the diaphragm relief valve 7, then, to make the valve 9 run reliably, the diaphragm relief valve 7 needs to be set at 5.5 bar, i.e. at a point which is above the point at which the poppet valve 9 could shimmer.

The improvement shown in FIG. 2 is one which could be retrofitted to the apparatus of FIG. 1.

The apparatus of FIGS. 4 and 5 is preferred in that it has no air control gear and no bag 4 or 15, since the opening pressure as well as the closing pressure of the poppet valve 9 are adjusted (or pre-set) on the valve itself. There are two methods of doing this, namely:

(1) By adjusting the length of the spring 13 by moving the plate 23, the opening and closing pressures change, i.e. the more pressure there is on the spring 13 the higher will be the opening and closing pressure of the poppet valve 9.

(2) By adjusting the length of the bellows 22 by moving the plate 24, the effective area of the bellows is changed, i.e. if the bellows is lengthened the effective area goes down and the valve opening and closing pressure goes up.

By a combination of the above and by changing the spring itself, most opening and closing pressures can be achieved.

It should be noted that changing the diameter of the bellows (or the diaphragm) and the poppet valve ratio also changes the valve opening and closing pressures.

The valves of the apparatus shown in FIGS. 1 to 3 have the problem that the valves tend to shimmer on their seats and not to open clearly (if they were to be used without the regulator valve).

Figure 6:
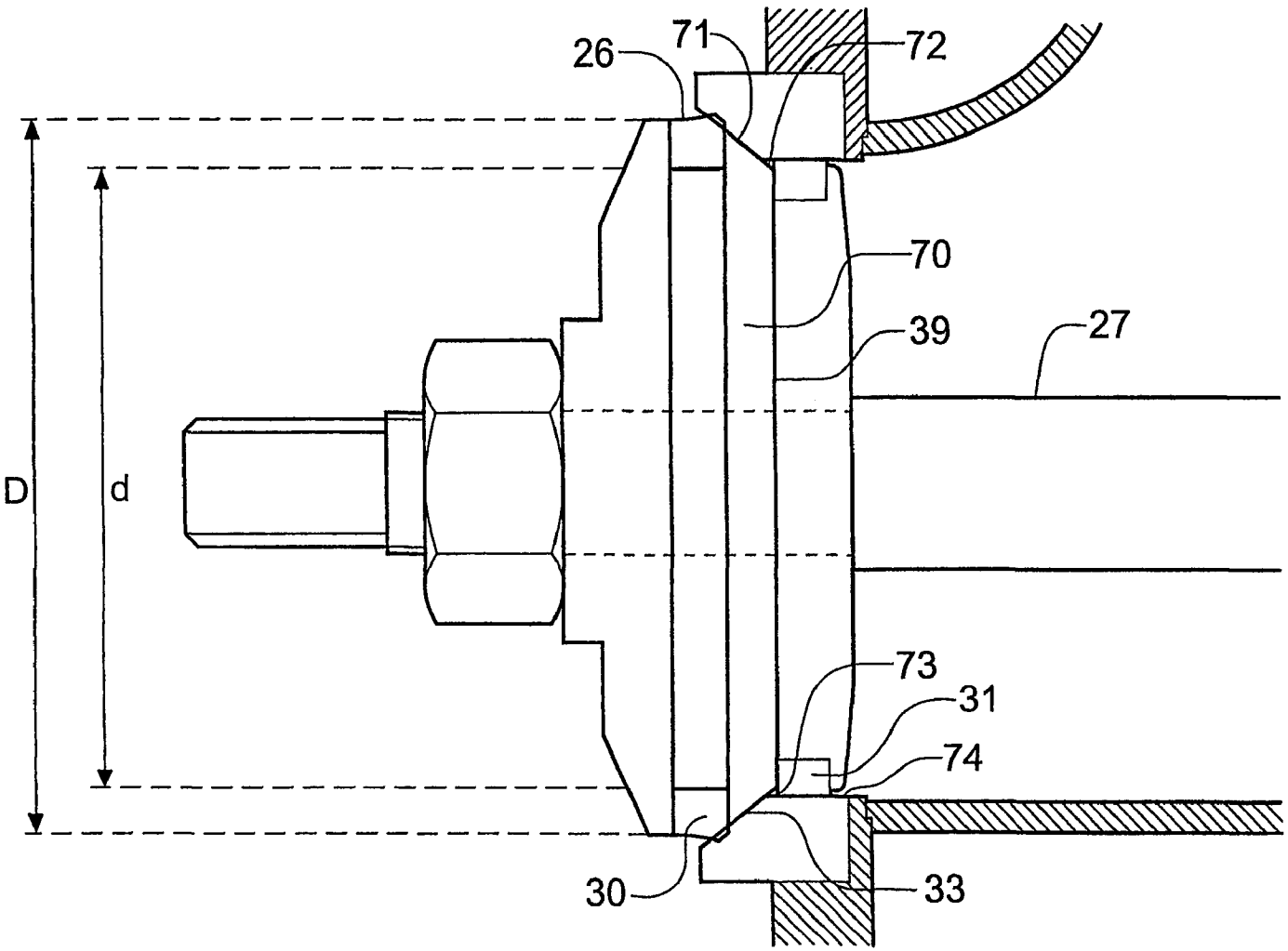
FIGS. 6 and 7 show alternative valves for use in the apparatus shown in FIGS. 2 to 5.

Referring to FIG. 6, there is shown an alternative poppet valve layout that can be used in place of the poppet valve shown in FIGS. 1 to 3. This valve has a closure member 26 mounted on a shaft 27 that is moveable by the action of the compression spring 13 (FIG. 5) and the bellows 22 (FIG. 5), or of the compression spring 13 and the poppet valve actuating diaphragm.

The closure member 26 has a first seal 30 and a second seal 31. As the valve begins to open (i.e. as the closure member 26 moves to the left), the first seal 30 looses contact with its respective seat, whereas the second seal 31 remains in contact with its respective seat. Upon further opening, the second seal 31 looses contact with its respective seat. Thus, the geometry of the valve changes during its opening, in that the effective diameter of the valve (and hence the resistance to be overcome in opening the valve) changes from diameter D to diameter d. The valve therefore has a reduced tendency to shimmer.

Figure 7:
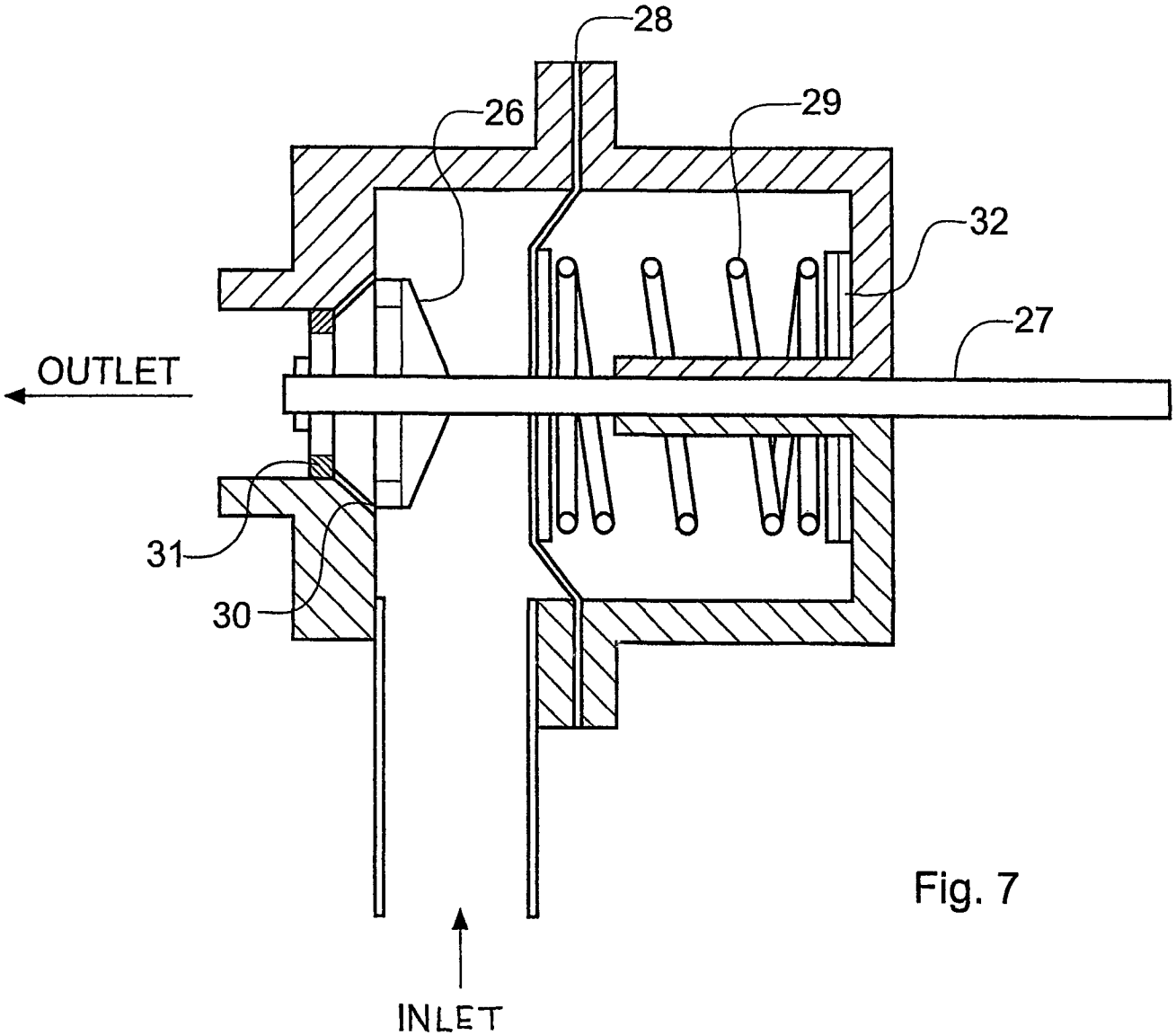

Referring to FIG. 7, there is shown an alternative poppet valve layout that can be used in place of the poppet valve shown in FIGS. 1 to 3. This valve has a closure member 26 mounted on a shaft 27 that is moveable by the activation of a diaphragm 28 against the action of a compression spring 29. The closure member 26, like that of FIG. 6, has a two stage opening area, i.e. a first seal 30 and a second seal 31, the first seal 30 being of larger diameter than the second seal 31 and the first seal 30 opening before the second seal 31 (as already described with reference to FIG. 6). This again overcomes the problem of the valve shown in FIGS. 1 to 3, namely the problem that the valve tends to shimmer on its seat and not to open cleanly.

The valve seals 30 and 31 are preferably made of flexible rubber.

The valve of FIG. 7 is driven by the pressure of the liquid under pressure that enters the inlet of the valve. This (increasing) pressure acts on the diaphragm 28 until the pressure is sufficient to overcome the force exerted on the diaphragm by the spring 29 and on the closure member 26 by the liquid. The valve then opens in two stages for a short period of time (by movement of the closure member 26 to the right), until the pressure falls to allow the diaphragm 28, and the closure member 26, to return to their original positions.

The valve can alternatively be driven by a separate supply of air under pressure.

One or more shims 32 can be located as shown to vary the pressure exerted by the spring 29 on the diaphragm 28.

In an alternative embodiment, the diaphragm 28 can be replaced by a bellows. Furthermore, the shaft 27 and the diaphragm 28 (or bellows) can be replaced by a plunger, with the spring 29 being located within the plunger. The stoke of the bellows can be adjustable so as to vary the pressure at which the valve is activated, i.e. opens.

The reciprocal movement of the shaft 27 (FIGS. 6 and 7) can be used to do work, for example to rotate the nozzle. The shaft 27 can also be used to mechanically hold the valve open or closed.

The purpose of the valves of FIGS. 6 and 7 is to provide poppet valves that do not shimmer on their seats but rather open cleanly. Since there is no bag 4 in the tank 5, any regulator valve in the air line 6 has to be able to deal with dirt. These regulator valves are described below with reference to FIGS. 8, 9 and 10.

The two-seal poppet valves of FIGS. 6 and 7 open cleanly. However, if they were to be used with only seal 31 in position, the valves would sometimes open far enough to allow water to leak through but would not fully open.

In the case of the use of two seals, seal 30 opens but seal 31 remains closed (since it runs parallel to the valve shaft), and the pressure applied to surface 33 after seal 30 has opened makes sure that seal 31 opens. In other words, the effective areas of the two seals 30 and 31 are different, and seal 31 is well past its balance point by the time it is asked to open.

The two-seal valves shown in FIGS. 6 and 7 overcome the problem of valve shimmering. However, this can be overcome by other means such as single rubber assembly. In its simplest form this can be a flexible part 70 able to flex so as to allow point 71 to open before point 72.

It is possible to make a slight modification to seal 31 by cutting a groove (6 mm×2 mm) from point 73 to point 74 to release water trapped between the two seals 30 and 31 to allow them to close properly.

Figure 13:
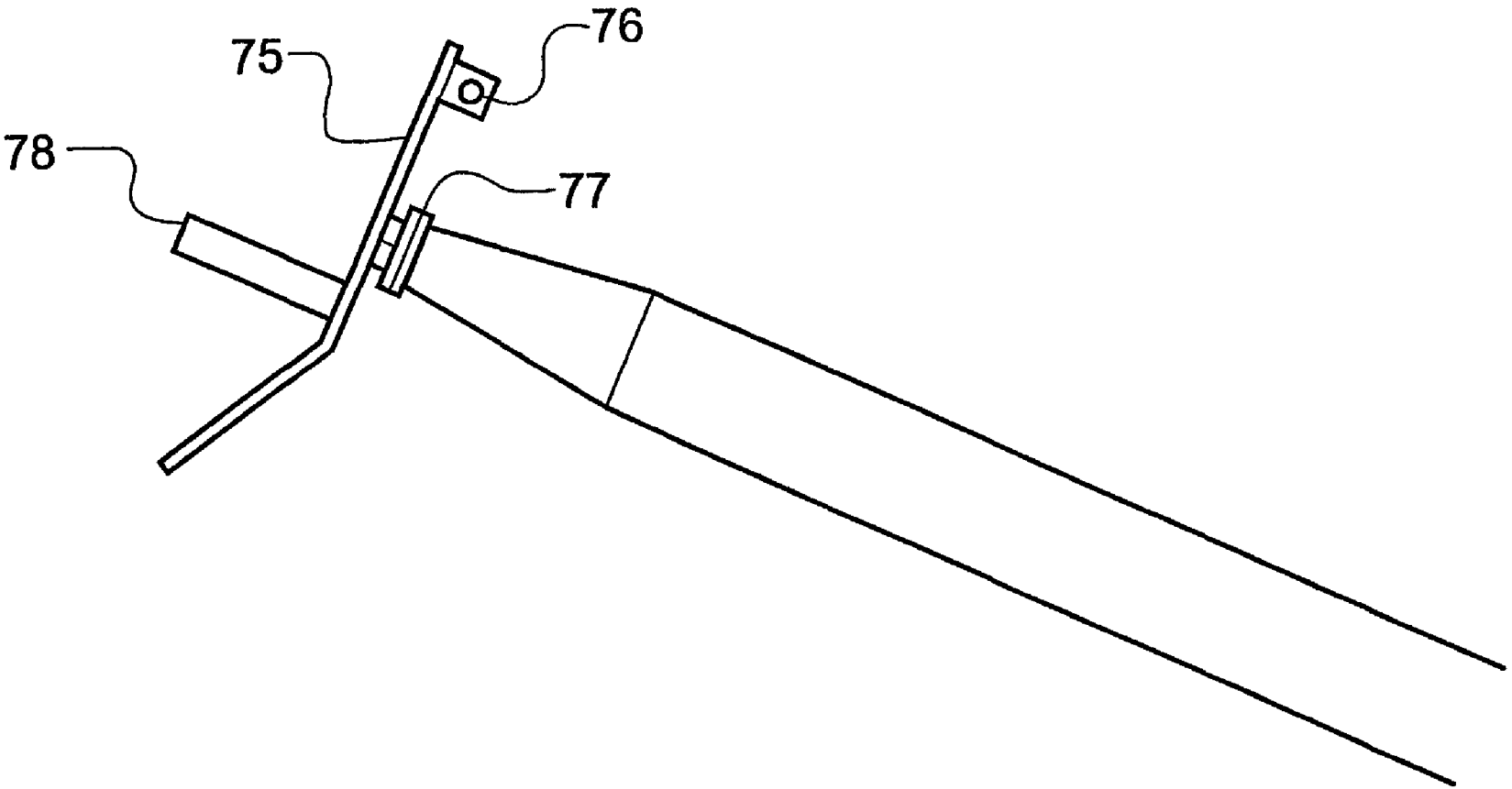
FIG. 13 shows a flap that may be fitted at the end of the nozzle.

As already noted, a single seal valve gives rise to the problem that the single seal tends to shimmer. As an alternative way to solve this problem, a flap 75 can be fitted on the end of the nozzle 11 (FIG. 1), as shown in FIG. 13, which also shows a pivot point 76, a rubber seal 77 and a weight 78.

Thus, any flap or steel ball mounted in the discharge tube could replace the two seal valve shown in FIGS. 6 and 7.

Figure 8:
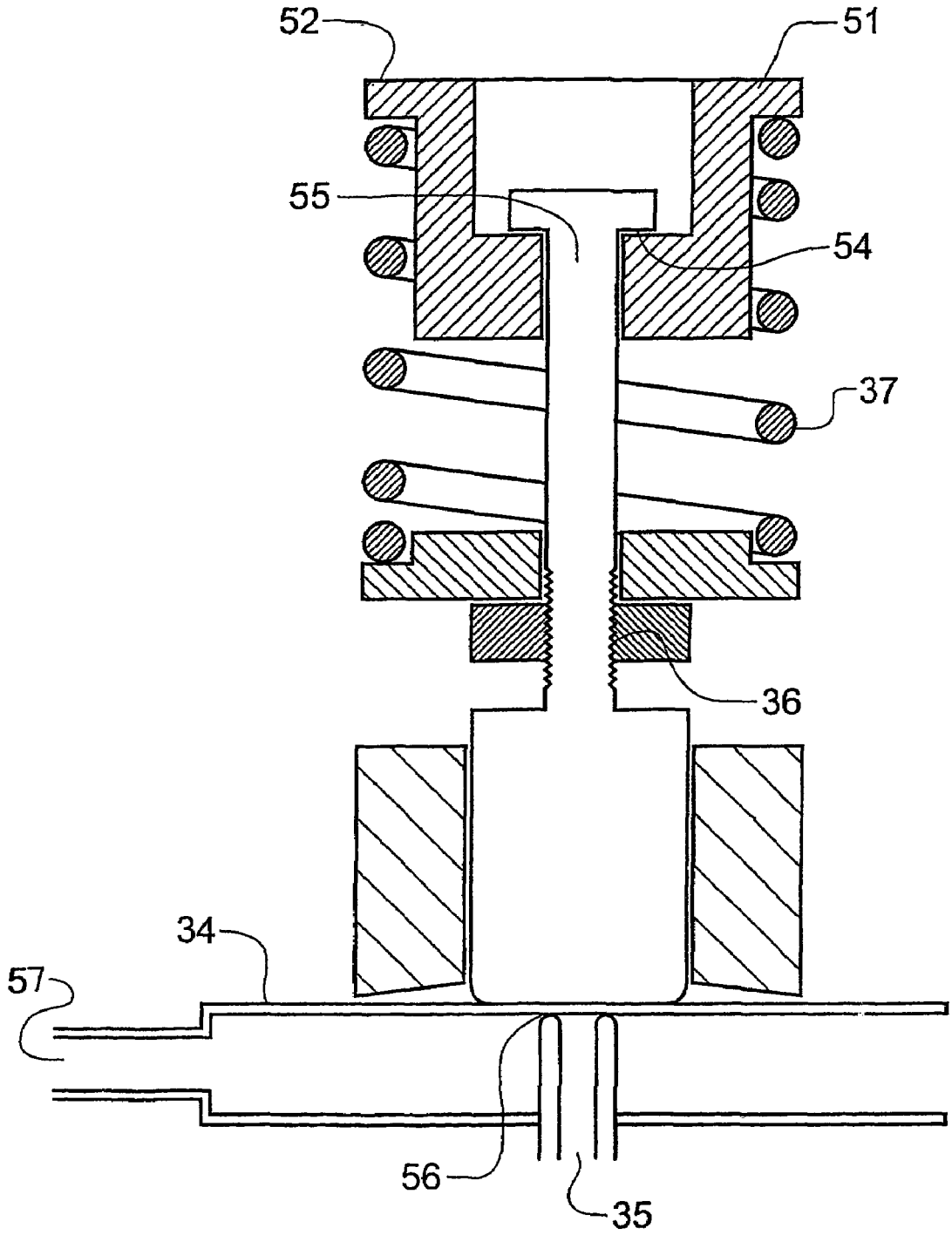
FIGS. 8, 9 and 10 show regulator valves for use in the apparatus shown in FIGS. 2 to 5.
Figure 9:
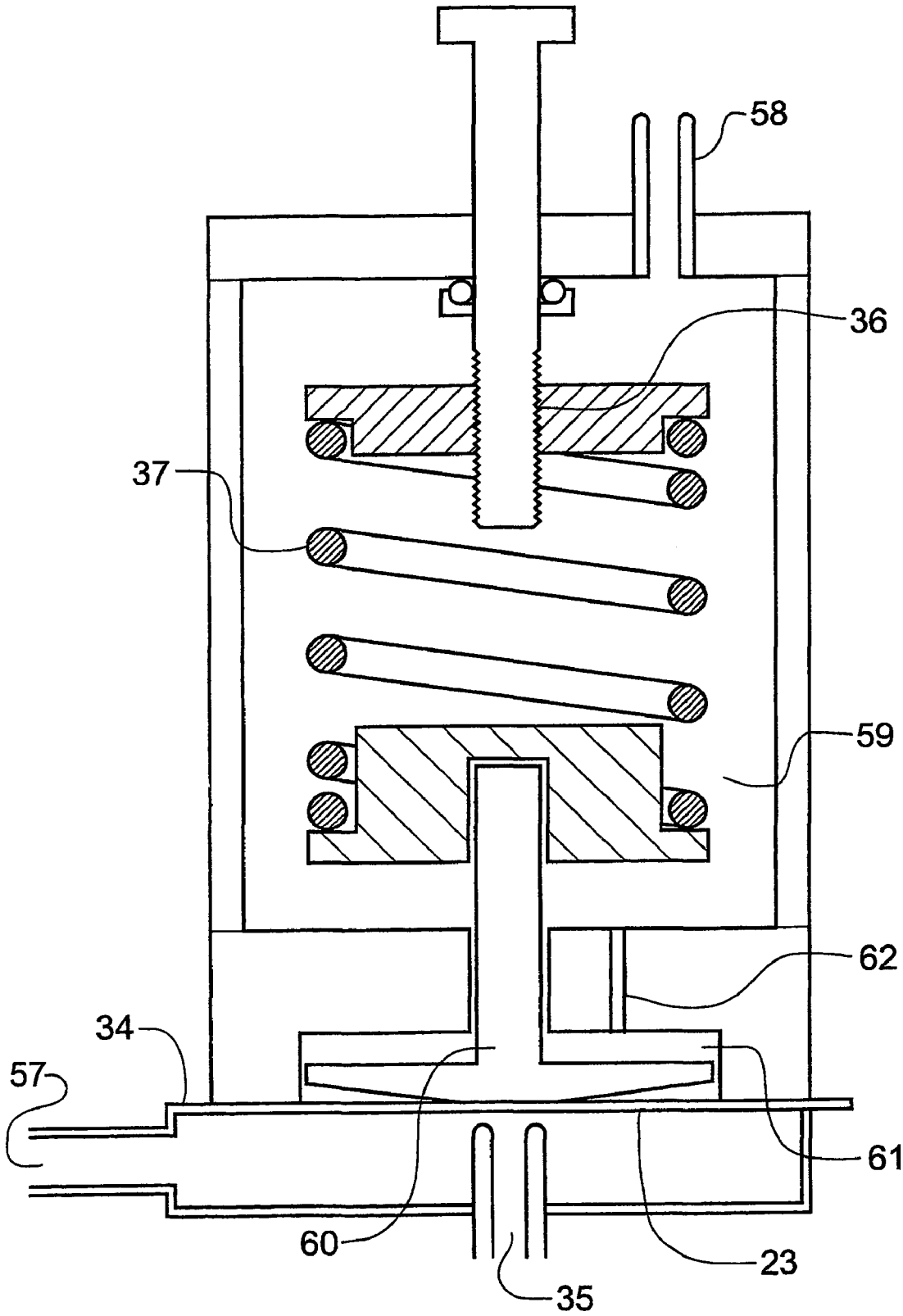

As mentioned above, FIGS. 8, 9 and 10 show regulator valves for use in regulating the apparatus of FIGS. 1 and 2. In FIGS. 8 and 9, there are shown valves each having a diaphragm 34 on which impinges a jet of air from a nozzle 35, the valves being adjustable by rotation of a threaded shaft 36 that varies the pressure applied on the diaphragm 34 by a coil spring 37.

Figure 10:
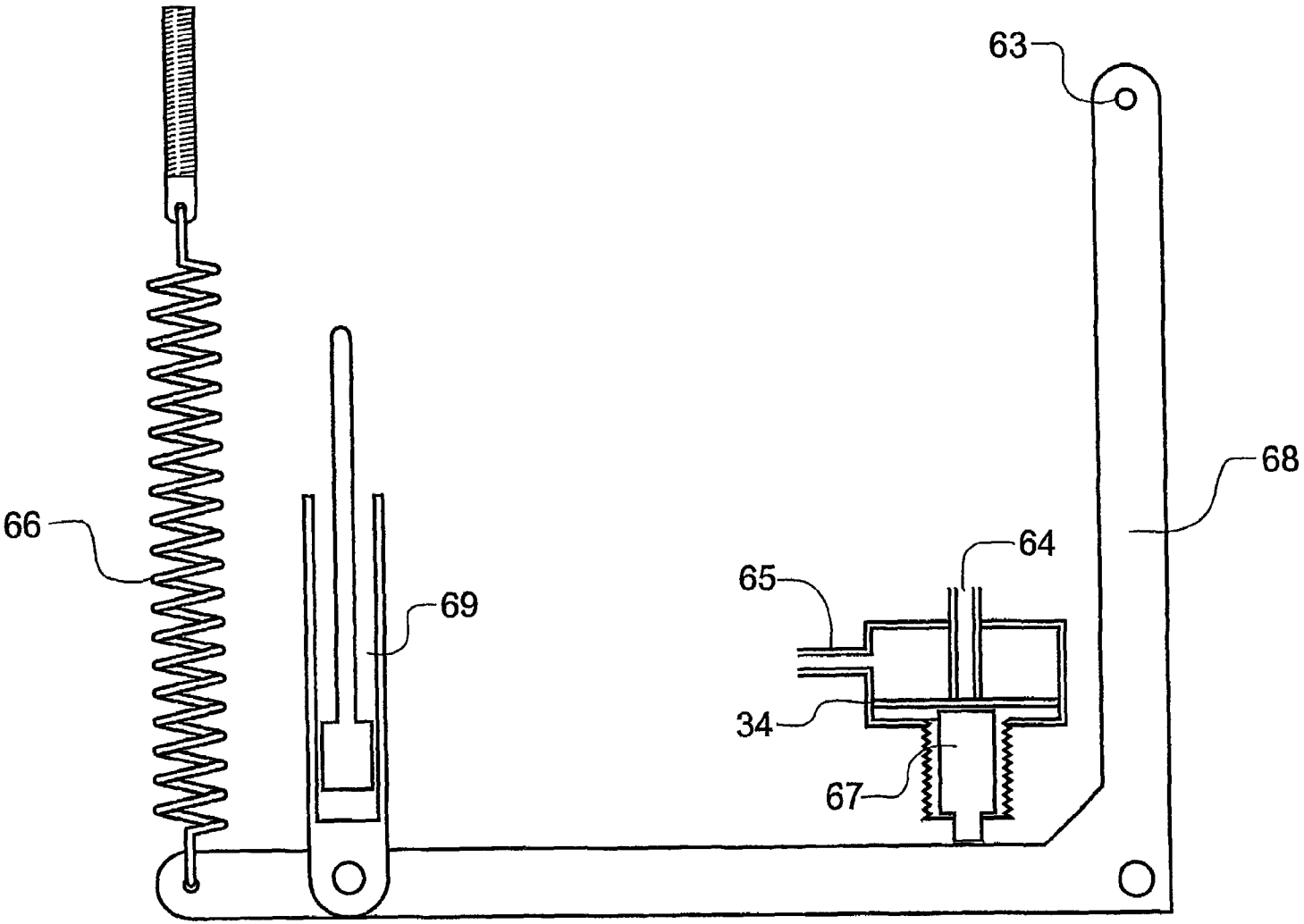

The valves shown in FIGS. 8, 9 and 10 replace the pressure valve 50 (consisting of diaphragm 52 and spring 54) of FIG. 3 of European Patent No. 0548159 (i.e. to replace valve 7 of FIG. 1 herein).

FIG. 8 shows more detail of a first air regulation system. Part 51 is mounted so that face 52 comes into contact with plate 53 (FIG. 5). When the main valve 9 closes, a gap forms at point 56 allowing spring 37 to close the regulator valve. Nozzle 35 is joined to air line 6 (FIG. 5), and tube 54 is joined to the main tank 5 (FIG. 4).

The mode of operation of the regulator valve is as follows. When the pressure in the tank 5 rises to a predetermined level, spring 37 allows plunger 55 to release diaphragm 34 allowing air to pass from the tank to the bellows on the valve head. As plate 53 (FIG. 5) moves away from part 51 no spring pressure is exerted on plunger 55 giving free passage of air at point 56. When the main valve 9 closes, gap 54 is reset ready for the next cycle.

FIG. 9 shows more detail of another air regulation system, which is not mechanically connected to main valve 9. Tube 35 is joined to the main tank 5 (FIG. 4). Tube 57 is joined to air line 6 (FIG. 5), and tube 58 is joined to air line 6 (to equalise the pressure in chamber 59).

The mode of operation of this regulator valve is as follows.

When the pressure in tank 5 rises to a predetermined level, spring 37 allows plunger 60 to release diaphragm 34 allowing air to pass from the tank 5 to the bellows on the valve head. Also, after the diaphragm has opened, a greater surface area is exposed on the diaphragm face. Fluid in chamber 61 is forced into chamber 59 via an orifice 62. As the pressure in the main tank 5 falls the closure of the regulator valve is delayed by the size of the orifice 62 and the viscosity of the fluid, as it returns to chamber 61.

FIG. 10 shows more detail of a third air regulation system. The lever at point 63 is joined (usually by a spring) to plate 53. Tube 64 is joined to air line 6 (FIG. 5), and tube 65 is joined to the main tank 5 (FIG. 4).

The mode of operation of this regulator valve is as follows.

When the pressure in tank 5 rises to a predetermined level, spring 66 allows plunger 67 to release diaphragm 34 allowing air to pass from the tank 5 to the bellows on the valve head. As the valve opens (because lever 68 is joined to the valve at plate 53), all the spring pressure is released between plunger 67 and jet 64 allowing free passage of air so as not to restrict debris. The regulator is held open by a damper 69 until the main valve has closed.

The arrangement of FIG. 10 provides a more reliable mechanical coupling of the regulator to the main valve with a dampening system.

It would be possible to use a hand operated valve or tap to run on its own or in series with the above, so that a pulse of water could be controlled by hand, for fire fighting, etc.

Figure 11:
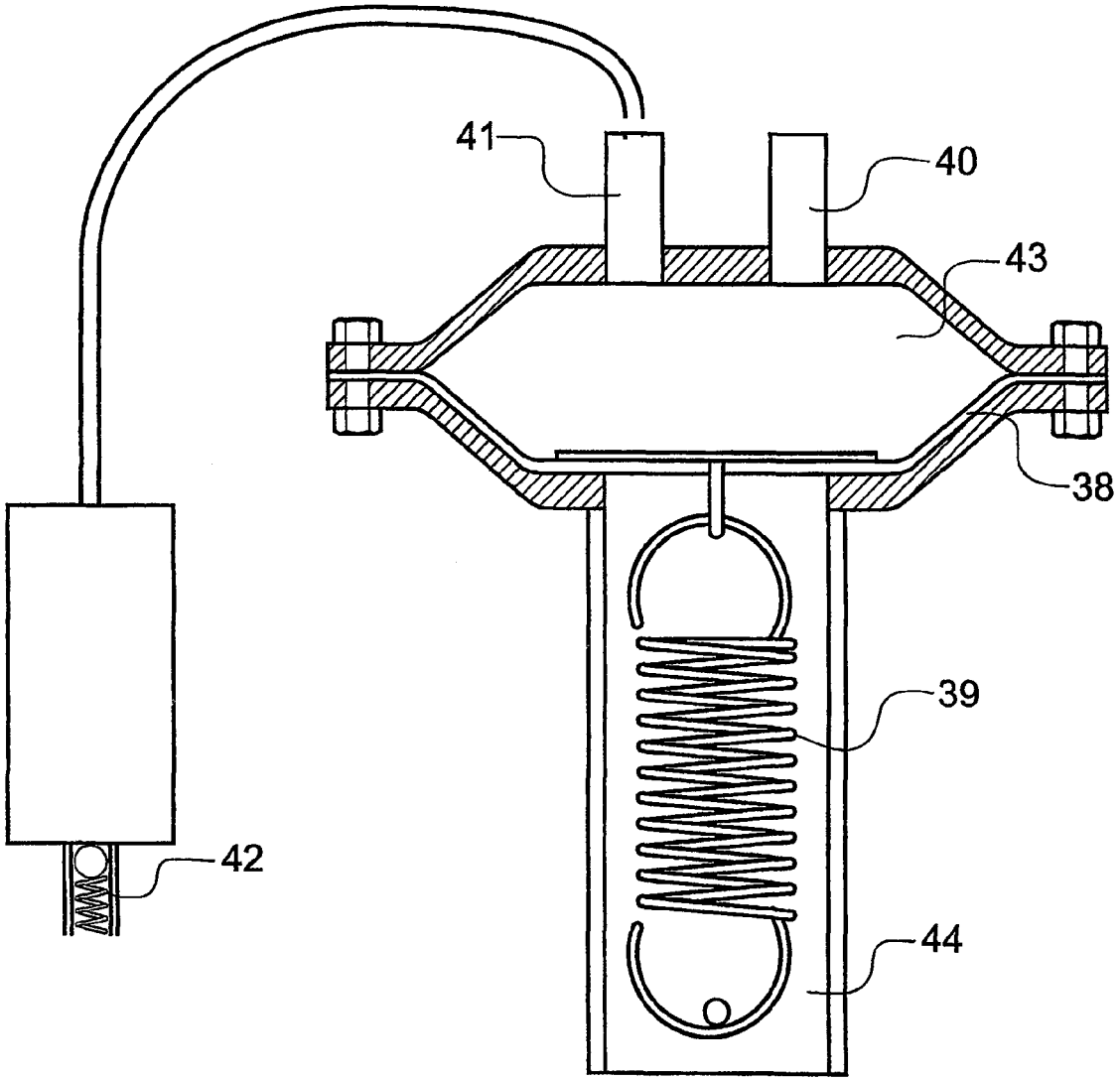
FIG. 11 shows a pump for use in the apparatus of FIGS. 2 to 5.

FIG. 11 shows a diaphragm pump for pumping air into the pressure vessel 5, and consisting of a diaphragm 38, a spring 39, and inlet valve 40, an outlet valve 41, and a non-return valve 42. The diaphragm 38 separates the pump into chambers 43 and 44, the latter chamber being in communication with chamber 10 of the apparatus, so that the operation of the poppet valve 9 causes the diaphragm pump to operate to pump air into the pressure vessel 5.

Figure 12:
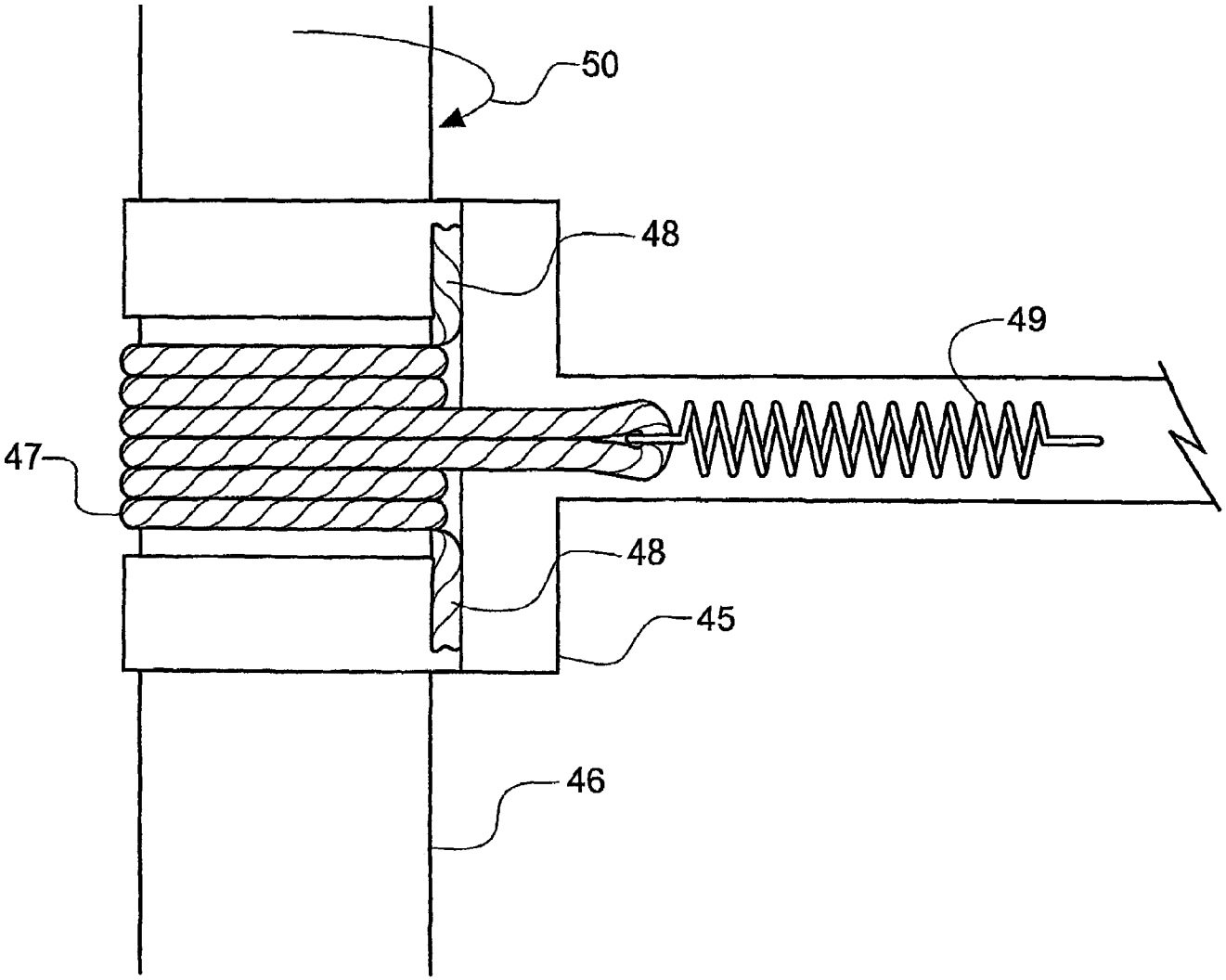
FIG. 12 shows an apparatus for rotating the nozzle arm of the apparatus of FIGS. 2 to 5.

FIG. 12 shows a mechanism for rotating the arm holding the nozzle 11. An assembly 45 is arranged to rotate around column 46, and a rope 47 is attached at points 48 to the rotating assembly 45, is wound around the assembly 45, and held tight by a spring 49.

When the rotating assembly 45 is turned in the direction of arrow 50, the rope 47 (or a strap) slides around the column 46. When the assembly 45 is reversed, the rope 47 locks onto column 46 and rotates it.

Thus, reciprocating movement of the spring 49 causes the rope or strap 47 to grip, or not to grip, the column 46, thereby causing or allowing stepwise rotation of the column 46.

A diaphragm or bellows unit in communication with chamber 10 of the apparatus provides a reciprocating movement to the assembly 45. The drive could also be taken from the tank side of the poppet valve 9, as could the drive for the pump of FIG. 11.

Figure 14:
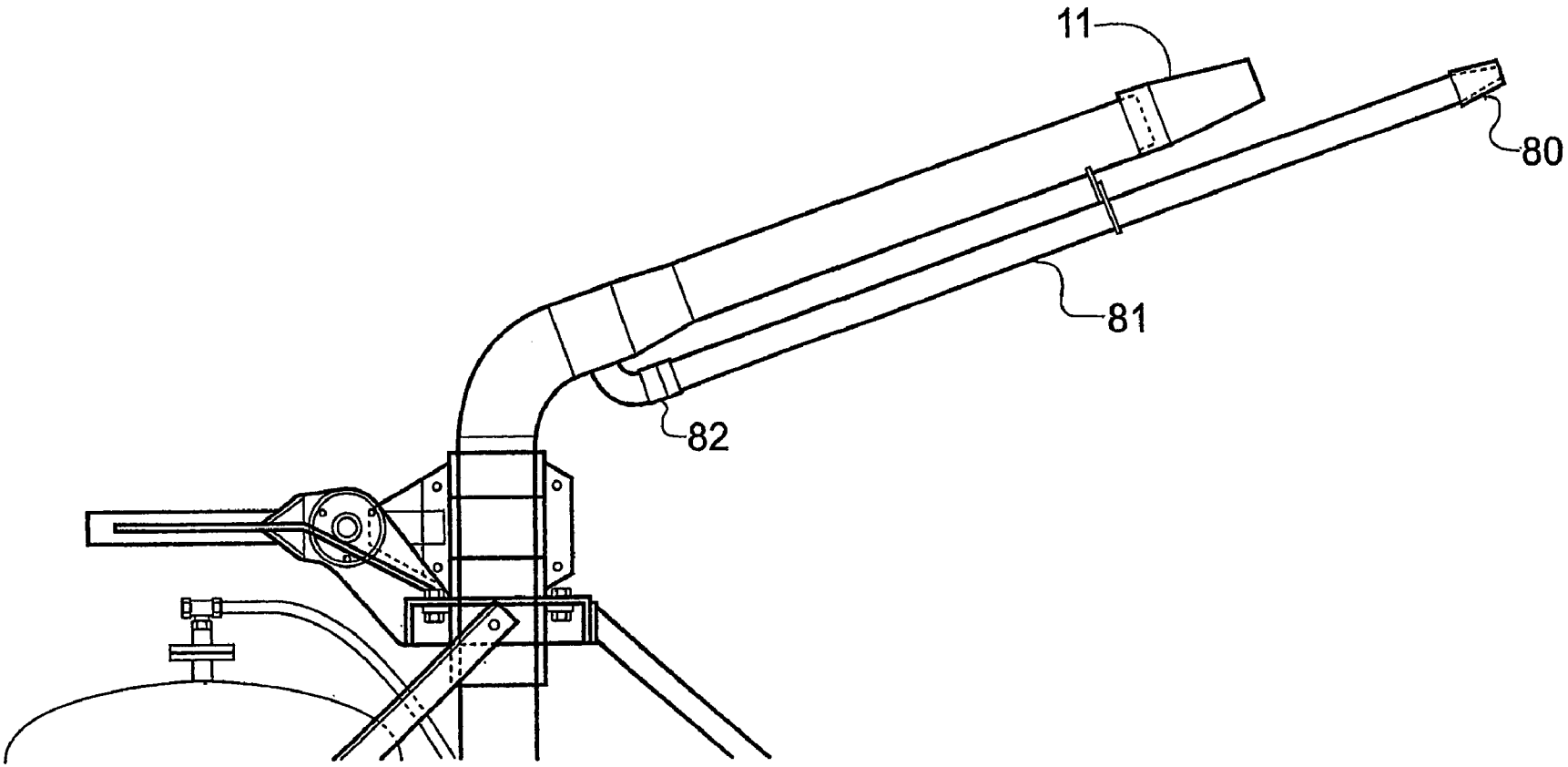
FIG. 14 shows a modification of the nozzle itself.

FIG. 14 shows another modification, in that the (main) nozzle 11, is provided with a second nozzle 80 at the end of a tube 81 connecting to the tube leading to the nozzle 11. The object of the two nozzles is to wet the ground evenly from the furthest range right back to the machine. Although the liquid from the nozzle does fall back as the pressure falls there can be an area in the middle which does not get wet enough. The second nozzle 80 is sized to overcome this problem. There are two main adjustments, namely (1) the sizes of tube 81 and of nozzle 80 (coarse adjustment), and (2), the presence of a restrictor in the tube 81, usually at point 82 (fine adjustment).

The invention claimed is:

1. A liquid delivery apparatus comprising (i) a first vessel into which a liquid may be introduced via an inlet to partially fill the first vessel and to pressurise the liquid that partially fills the first vessel and the air that fills the remainder of the first vessel;

(ii) an outlet via which said liquid may be discharged from the first vessel under the pressure of the liquid and air in the first vessel;

(iii) a valve between the first vessel and the outlet to control passage of liquid from the first vessel to the outlet, said valve having (a) an opening, (b) a closure member adapted to close the opening, and (c) a biasing means, the arrangement of the components of the valve being such that the valve is normally held closed by the biasing means;

(iv) a valve control mechanism for controlling the operation of the valve in response to the pressure of the liquid and air in the first vessel;

(v) a means for transmitting the pressure of the liquid and air in the first vessel to a first chamber of a second vessel that includes an inner moveable wall which sub-divides the second vessel into said first chamber and a second chamber which are of variable volume depending upon the position of the said inner moveable wall in the vessel; and (vi) a means for transmitting the pressure of the air in the second chamber of the second vessel to the valve control mechanism;

wherein the valve control mechanism comprises a moveable element which is capable of being acted on by the pressure of the air in the second chamber and transmitting a resultant force to the closure member of the valve in a direction to open the valve, and wherein the respective effective surface areas of the moveable element and the closure member and the force of the biasing means are chosen such that the closure member is opened when the pressure of the liquid and air in the first vessel reaches a predetermined level.

2. An apparatus as claimed in claim 1, wherein the inlet includes an upright tube extending upwardly into the vessel or the first vessel, the height of the tube in the vessel determining the level of liquid remaining in the vessel after discharge.

3. An apparatus as claimed in claim 1, wherein a baffle plate is disposed in the first vessel, between the valve opening and the inlet, so as partially to subdivide the interior of the vessel or the first vessel into first and second compartments such that flow of liquid from one compartment to the other is possible.

4. An apparatus as claimed in claim 1, wherein the inlet to the first vessel includes a non-return valve.

5. An apparatus as claimed in claim 1, wherein the moveable element of the valve control mechanism comprises either a diaphragm in a pressure chamber or a bellows.

6. An apparatus as claimed in claim 5, including means for varying the length of the bellows.

7. An apparatus as claimed in claim 1, wherein the biasing means comprises a compression spring, and wherein the apparatus includes means for varying the degree of compression of the compression spring.

8. An apparatus as claimed in claim 1, wherein the means for transmitting the pressure to the valve control mechanism comprises a first pressure line directly connecting the first vessel to the first chamber of the second vessel and a second pressure line directly connecting the second chamber of the second vessel to the pressure chamber containing the diaphragm or to the bellows.

9. An apparatus as claimed in claim 8, wherein a regulating tank is disposed in either of both of the first and second pressure lines.

10. An apparatus as claimed in claim 1, wherein the closure member of the valve is one that is able to open in two or more stages in which the closure member has different effective surface areas such that the force required to open the valve is less in the second (or subsequent) stage than it is in the first (or previous) stage.

11. An apparatus as claimed in claim 6, wherein the diaphragm or the bellows is acted on directly by the pressure of the liquid introduced via the inlet.

12. An apparatus as claimed in claim 1, wherein the outlet via which the liquid may be discharged comprises an upright rotatable discharge tube having one or more offset discharge nozzles connected thereto.

13. An apparatus as claimed in claim 12, having a moveable flap mounted at the end of the discharge nozzle, or having a moveable ball mounted in the discharge nozzle.

14. An apparatus as claimed in claim 12 or 13, wherein the rotatable discharge tube has a rope or strap wound around it via which reciprocating movement of the rope or strap can cause or allow rotation of the discharge tube in a stepwise manner.

15. An apparatus as claimed in claim 12, wherein the rotatable discharge tube is rotated by a drive mechanism that in turn is driven by a bellows that in turn is driven by pressure change.

16. An apparatus as claimed in claim 1, further comprising a pump for pumping air into the first vessel.

17. An apparatus as claimed in claim 16 wherein the pump is driven by pressure change.

18. An apparatus as claimed in claim 16 wherein the pump is a diaphragm pump having a diaphragm which is connected to the outlet on one side and to the atmosphere and the first vessel on the other side.

19. An apparatus as claimed in claim 3, wherein the baffle plate contains an opening such that gas trapped beneath the baffle plate can escape into the first vessel.

20. A liquid delivery apparatus comprising (i) a vessel into which a liquid may be introduced via an inlet to partially fill the vessel and to pressurise the liquid that partially fills the vessel and the air that fills the remainder of the vessel;

(ii) an outlet via which said liquid may be discharged from the vessel under the pressure of the liquid and air in the vessel;

(iii) a valve between the vessel and the outlet to control passage of liquid from the vessel to the outlet, said valve having (a) an opening, (b) a closure member adapted to close the opening, and (c) a biasing means, the arrangement of the components of the valve being such that the valve is normally held closed by the biasing means;

(iv) a valve control mechanism for controlling the operation of the valve in response to the pressure of the liquid and air in the vessel, the valve control mechanism comprising a diaphragm contained in a pressure chamber;

(v) a means for transmitting the pressure of the liquid and air in the vessel to the valve control mechanism, said means comprising a pressure line directly connecting the vessel to the pressure chamber containing the diaphragm; and (vi) a pump for pumping air into the vessel;

wherein the diaphragm is capable of being acted on by the pressure of the liquid and air in the vessel and transmitting a resultant force to the closure member of the valve in a direction to open the valve, and wherein the respective effective surface areas of the moveable element and the closure member and the force of the biasing means are chosen such that the closure member is openable when the pressure of the liquid and air in the vessel reaches a predetermined level.

21. An apparatus as claimed in claim 20, wherein the inlet includes an upright tube extending upwardly into the vessel or the first vessel, the height of the tube in the vessel determining the level of liquid remaining in the vessel after discharge.

22. An apparatus as claimed in claim 20, wherein a baffle plate is disposed in the vessel, between the valve opening and the inlet, so as partially to subdivide the interior of the vessel into first and second compartments such that flow of liquid from one compartment to the other is possible.

23. An apparatus as claimed in claim 22, wherein the baffle plate contains an opening such that gas trapped beneath the baffle plate can escape into the first vessel.

24. An apparatus as claimed in claim 20, wherein the inlet to the vessel includes a non-return valve.

25. An apparatus as claimed in claim 20, wherein a regulating tank is disposed in the pressure line.

26. An apparatus as claimed claim 20, wherein the closure member of the valve is one that is able to open in two or more stages in which the closure member has different effective surface areas such that the force required to open the valve is less in the second (or subsequent) stage than it is in the first (or previous) stage.

27. An apparatus as claimed in claim 20, wherein the diaphragm is acted on directly by the pressure of the liquid introduced via the inlet.

28. An apparatus as claimed in claim 20, wherein the outlet via which the liquid may be discharged comprises an upright rotatable discharge tube having one or more offset discharge nozzles connected thereto.

29. An apparatus as claimed in claim 28, having a moveable flap mounted at the end of the discharge nozzle, or having a moveable ball mounted in the discharge nozzle.

30. An apparatus as claimed in claim 28, wherein the rotatable discharge tube has a rope or strap wound around it via which reciprocating movement of the rope or strap can cause or allow rotation of the discharge tube in a stepwise manner.

31. An apparatus as claimed in 28, wherein the rotatable discharge tube is rotated by a drive mechanism that in turn is driven by a bellows that in turn is driven by pressure change in the outlet.

32. An apparatus as claimed in claim 20 wherein the pump is driven by pressure change in the outlet.

33. An apparatus as claimed in claim 32 wherein the pump is a diaphragm pump having a diaphragm which is connected to the outlet on one side and to the atmosphere and the first vessel on the other side.

34. A liquid delivery apparatus comprising (i) a vessel into which a liquid may be introduced via an inlet to partially fill the vessel and to pressurise the liquid that partially fills the vessel and the air that fills the remainder of the vessel;

(ii) an outlet via which said liquid may be discharged from the vessel under the pressure of the liquid and air in the vessel;

(iii) a valve between the vessel and the outlet to control passage of liquid from the vessel to the outlet, said valve having (a) an opening, (b) a closure member adapted to close the opening, and (c) a biasing means, the arrangement of the components of the valve being such that the valve is normally held closed by the biasing means;

(iv) a valve control mechanism for controlling the operation of the valve in response to the pressure of the liquid and air in the vessel, the valve control mechanism comprising a bellows;

(v) a means for transmitting the pressure of the liquid and air in the vessel to the valve control mechanism, said means comprising a pressure line directly connecting the vessel to the bellows; and (vi) a regulating tank is disposed in the pressure line;

wherein the bellows is capable of being acted on by the pressure of the liquid and air in the vessel and transmitting a resultant force to the closure member of the valve in a direction to open the valve, and wherein the respective effective surface areas of the moveable element and the closure member and the force of the biasing means are chosen such that the closure member is openable when the pressure of the liquid and air in the vessel reaches a predetermined level.

35. An apparatus as claimed in claim 34, wherein the inlet includes an upright tube extending upwardly into the vessel or the first vessel, the height of the tube in the vessel determining the level of liquid remaining in the vessel after discharge.

36. An apparatus as claimed in claim 34, wherein a baffle plate is disposed in the vessel, between the valve opening and the inlet, so as partially to subdivide the interior of the vessel into first and second compartments such that flow of liquid from one compartment to the other is possible.

37. An apparatus as claimed in claim 36, wherein the baffle plate contains an opening such that gas trapped beneath the baffle plate can escape into the first vessel.

38. An apparatus as claimed in claim 34, wherein the inlet to the vessel includes a non-return valve.

39. An apparatus as claimed claim 34, wherein the closure member of the valve is one that is able to open in two or more stages in which the closure member has different effective surface areas such that the force required to open the valve is less in the second (or subsequent) stage than it is in the first (or previous) stage.

40. An apparatus as claimed in claim 34, wherein the diaphragm or the bellows is acted on directly by the pressure of the liquid introduced via the inlet.

41. An apparatus as claimed in claim 34, wherein the outlet via which the liquid may be discharged comprises an upright rotatable discharge tube having one or more offset discharge nozzles connected thereto.

42. An apparatus as claimed in claim 41, having a moveable flap mounted at the end of the discharge nozzle, or having a moveable ball mounted in the discharge nozzle.

43. An apparatus as claimed in claim 41, wherein the rotatable discharge tube has a rope or strap wound around it via which reciprocating movement of the rope or strap can cause or allow rotation of the discharge tube in a stepwise manner.

44. An apparatus as claimed in claim 41, wherein the rotatable discharge tube is rotated by a drive mechanism that in turn is driven by a bellows that in turn is driven by pressure change.

45. An apparatus as claimed in claim 34, further comprising a pump for pumping air into the vessel.

46. An apparatus as claimed in claim 45 wherein the pump is driven by pressure change in the outlet.

47. An apparatus as claimed in claim 46 wherein the pump is a diaphragm pump having a diaphragm which is connected to the outlet on one side and to the atmosphere and the first vessel on the other side.

48. A liquid delivery apparatus comprising (i) a vessel into which a liquid may be introduced via an inlet to partially fill the vessel and to pressurise the liquid that partially fills the vessel and the air that fills the remainder of the vessel;

(ii) an outlet via which said liquid may be discharged from the vessel under the pressure of the liquid and air in the vessel;

(iii) a valve between the vessel and the outlet to control passage of liquid from the vessel to the outlet, said valve having (a) an opening, (b) a closure member adapted to close the opening, open in two or more stages in which the closure member has different effective surface areas such that the force required to open the valve is less in the second (or subsequent) stage than it is in the first (or previous) stage, and (c) a biasing means, the arrangement of the components of the valve being such that the valve is normally held closed by the biasing means;

(iv) a valve control mechanism for controlling the operation of the valve in response to the pressure of the liquid and air in the vessel; and (v) a means for transmitting the pressure of the liquid and air in the vessel to the valve control mechanism;

wherein the valve control mechanism comprises a moveable element which is capable of being acted on by the pressure of the liquid and air in the vessel and transmitting a resultant force to the closure member of the valve in a direction to open the valve, and wherein the respective effective surface areas of the moveable element and the closure member and the force of the biasing means are chosen such that the closure member is openable when the pressure of the liquid and air in the vessel reaches a predetermined level.

49. An apparatus as claimed in claim 48, wherein the inlet includes an upright tube extending upwardly into the vessel, the height of the tube in the vessel determining the level of liquid remaining in the vessel after discharge.

50. An apparatus as claimed in claim 48, wherein a baffle plate is disposed in the vessel, between the valve opening and the inlet, so as partially to subdivide the interior of the vessel into first and second compartments such that flow of liquid from one compartment to the other is possible.

51. An apparatus as claimed in claim 50, wherein the baffle plate contains an opening such that gas trapped beneath the baffle plate can escape into the first vessel.

52. An apparatus as claimed in claim 48, wherein the inlet to the vessel includes a non-return valve.

53. An apparatus as claimed in claim 48, wherein the moveable element of the valve control mechanism comprises either a diaphragm in a pressure chamber or a bellows.

54. An apparatus as claimed in claim 53, including means for varying the length of the bellows.

55. An apparatus as claimed in claim 53, wherein the means for transmitting the pressure to the valve control mechanism comprises a pressure line directly connecting the vessel to the pressure chamber containing the diaphragm or to the bellows.

56. An apparatus as claimed in claim 55, wherein a regulating tank is disposed in the pressure line.

57. An apparatus as claimed in claim 53, wherein the diaphragm or the bellows is acted on directly by the pressure of the liquid introduced via the inlet.

58. An apparatus as claimed in claim 48, wherein the outlet via which the liquid may be discharged comprises an upright rotatable discharge tube having one or more offset discharge nozzles connected thereto.

59. An apparatus as claimed in claim 58, having a moveable flap mounted at the end of the discharge nozzle, or having a moveable ball mounted in the discharge nozzle.

60. An apparatus as claimed in claim 58, wherein the rotatable discharge tube has a rope or strap wound around it via which reciprocating movement of the rope or strap can cause or allow rotation of the discharge tube in a stepwise manner.

61. An apparatus as claimed in 58, wherein the rotatable discharge tube is rotated by a drive mechanism that in turn is driven by a bellows that in turn is driven by pressure change in the outlet.

62. An apparatus as claimed in claim 48, further comprising a pump for pumping air into the vessel.

63. An apparatus as claimed in claim 62 wherein the pump is driven by pressure change in the outlet.

64. An apparatus as claimed in claim 63 wherein the pump is a diaphragm pump having a diaphragm which is connected to the outlet on one side and to the atmosphere and the first vessel on the other side.

65. A liquid delivery apparatus comprising:

(i) a vessel into which a liquid may be introduced via an inlet to partially fill the vessel and to pressurise the liquid that partially fills the vessel and the air that fills the remainder of the vessel, the inlet including an upright tube extending upwardly into the vessel, the height of the tube in the vessel determining the level of liquid remaining in the vessel after discharge;

(ii) an outlet via which said liquid may be discharged from the vessel under the pressure of the liquid and air in the vessel;

(iii) a valve between the vessel and the outlet to control passage of liquid from the vessel to the outlet, said valve having (a) an opening, (b) a closure member adapted to close the opening, and (c) a biasing means, the arrangement of the components of the valve being such that the valve is normally held closed by the biasing means;

(iv) a valve control mechanism for controlling the operation of the valve in response to the pressure of the liquid and air in the vessel; and (v) a means for transmitting the pressure of the liquid and air in the vessel to the valve control mechanism;

wherein the valve control mechanism comprises a moveable element which is capable of being acted on by the pressure of the liquid and air in the vessel and transmitting a resultant force to the closure member of the valve in a direction to open the valve, and wherein the respective effective surface areas of the moveable element and the closure member and the force of the biasing means are chosen such that the closure member is openable when the pressure of the liquid and air in the vessel reaches a predetermined level.

66. A liquid delivery apparatus comprising (i) a vessel into which a liquid may be introduced via an inlet to partially fill the vessel and to pressurise the liquid that partially fills the vessel and the air that fills the remainder of the vessel;

(ii) an outlet via which said liquid may be discharged from the vessel under the pressure of the liquid and air in the vessel;

(iii) a valve between the vessel and the outlet to control passage of liquid from the vessel to the outlet, said valve having (a) an opening, (b) a closure member adapted to close the opening, and (c) a biasing means, the arrangement of the components of the valve being such that the valve is normally held closed by the biasing means;

(iv) a valve control mechanism for controlling the operation of the valve in response to the pressure of the liquid and air in the vessel;

(v) a means for transmitting the pressure of the liquid and air in the vessel to the valve control mechanism; and (vi) a baffle plate disposed in the vessel between the valve opening and the inlet, so as partially to subdivide the interior of the vessel into first and second compartments such that flow of liquid from one compartment to the other is possible;

wherein the valve control mechanism comprises a moveable element which is capable of being acted on by the pressure of the liquid and air in the vessel and transmitting a resultant force to the closure member of the valve in a direction to open the valve, and wherein the respective effective surface areas of the moveable element and the closure member and the force of the biasing means are chosen such that the closure member is openable when the pressure of the liquid and air in the vessel reaches a predetermined level.

* * * * *